US005305891A

United States Patent [19]

Bielagus

[11] Patent Number: 5,305,891

[45] Date of Patent: Apr. 26, 1994

[54] WOOD CHIP BAR SCREEN DECK ARRANGEMENT

[75] Inventor: Joseph B. Bielagus, Tualatin, Oreg.

[73] Assignee: Beloit Technologies, Inc., Wilmington, Del.

[21] Appl. No.: 724,095

[22] Filed: Jul. 1, 1991

Related U.S. Application Data

[63] Continuation-in-part of Ser. No. 629,924, Dec. 19, 1990, abandoned.

[51] Int. Cl.[5] ..... B07B 1/49

[52] U.S. Cl. ..... 209/396; 209/267; 209/324; 209/674

[58] Field of Search ..... 209/267, 320, 324, 393, 209/396, 674

[56] References Cited

U.S. PATENT DOCUMENTS

| | | | |
|---|---|---|---|
| 1,508,416 | 9/1924 | Sheldon | 209/396 X |
| 1,552,397 | 9/1925 | Edwards | 209/396 |
| 3,067,855 | 12/1962 | Lambert | 198/76 |
| 4,452,694 | 6/1984 | Christensen et al. | 209/672 |
| 4,504,386 | 3/1985 | Dyrén et al. | 209/254 |
| 4,558,787 | 12/1985 | Danielsson et al. | 209/626 |
| 4,660,726 | 4/1987 | Woode | 209/674 |
| 4,901,863 | 2/1990 | Lancaster | 209/664 |

FOREIGN PATENT DOCUMENTS

| | | | |
|---|---|---|---|
| 3509079 | 2/1986 | Fed. Rep. of Germany . | |
| 3926451 | 3/1991 | Fed. Rep. of Germany . | |
| 88615 | 2/1937 | Sweden | 209/396 |
| 2160124 | 12/1985 | United Kingdom . | |
| 9101816 | 2/1991 | World Int. Prop. O. | 209/396 |

*Primary Examiner*—Andres Kashnikow
*Assistant Examiner*—Joseph A. Kaufman
*Attorney, Agent, or Firm*—Dirk J. Veneman; Raymond W. Campbell

[57] ABSTRACT

A screening deck for a wood chip screening apparatus including a plurality of parallel bars mounted in separate, interlaced grids, with the bars of at least one grid having top surfaces disposed in at least two planes, such that, during oscillatory movement of the grids, at all times at least two bar height positions result, for promoting chip action.

7 Claims, 8 Drawing Sheets

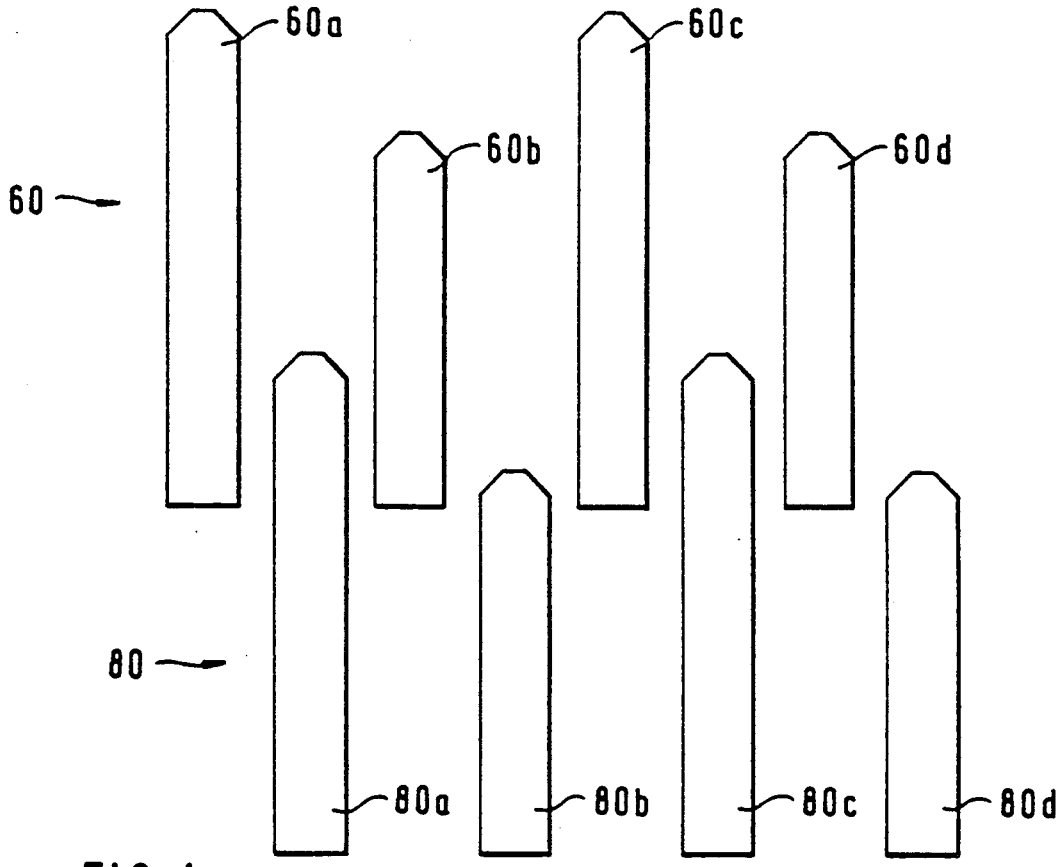
FIG. 4
FIG. 5
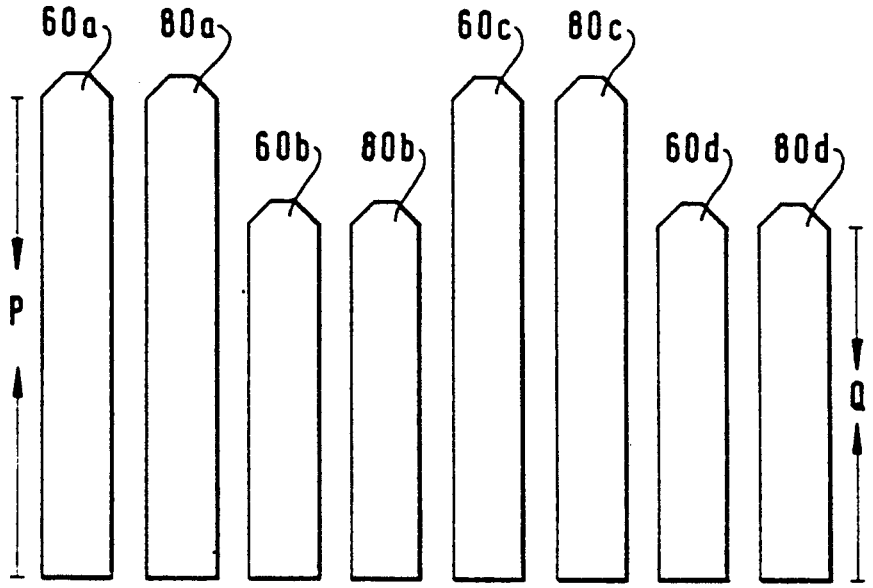

WOOD CHIP BAR SCREEN DECK ARRANGEMENT

CROSS-REFERENCE TO RELATED APPLICATIONS

This application is a continuation-in-part of co-pending U.S. Ser. No. 07/629,924 filed Dec. 19, 1990 now abandoned.

BACKGROUND OF THE INVENTION

The present invention relates to improvements in apparatus for screening particulate material such as wood chips.

More particularly, the invention pertains to a screening deck defining a screening area, wherein the deck is formed of a series of parallel bars with spaces therebetween, with the bars uniquely arranged to increase the screen capacity through rapid orientation of the material in the direction of the slots between the bars.

In a common process for the manufacture of pulp for producing paper, logs are reduced to chips by chipping mechanisms, and the chips are cooked with chemicals at elevated pressures and temperature to remove lignin. The chipping mechanisms produce chips which vary considerably in size and shape. For the cooking process, which is known as digesting, it is desirable that the chips supplied have a uniform thickness in order to achieve optimum yield and quality; that is, to obtain a pulp which contains a low percentage of undigested and/or overtreated fibers. Under preferred conditions of digesting, the pulping chemicals or liquor penetrates into chips uniformly. If chips are provided which have too great a thickness, the liquor may not adequately penetrate the chips and the digester will produce chips with a core of under-digested fibers. If chips are provided which are too thin, the digester will produce chips that are overcooked and of low quality. To insure proper delignification of the chips in the production of pulp, the supply should not contain chips having an excessive thickness which will give rise to lack of adequate penetration during the digestion process, nor chips which are overly thin and may be overtreated during the digestion process.

Apparatus has been provided heretofore for screening chips to separate the over-thick and under-thick chips from those within the desired thickness range. Customarily, these screening devices are of the disk screen type, which have a plurality of generally circular disks mounted on parallel, rotating shafts. The disks are mounted coaxially on each shaft and spaced from each other, and the disks interleave with the disks of adjacent shafts to form screening gaps between the disks of one shaft and the disks of adjacent shafts. Through proper disk spacing, the screen can be used to separate either under-size or over-size chips from a stream of chips supplied to the screen.

One drawback associated with disk screening apparatus is that the effective or open screen area in a given screen dimension is necessarily limited, and the number of shafts provided with the disks will, therefore, be large in an industrial installation requiring substantial production capacity. Another drawback is that, by reason of precision requirements of the gaps between the disks, the manufacturing costs are relatively high. Since the disks of adjacent shafts interleave with each other in the screening area, there is friction on the surfaces interleaved due to the material to be screened becoming lodged between the disks and also by reason of resin deposits on the disks. The counter-rotational relationship between adjacent interleaved surfaces can force material into the gap, degrading chip quality and further increasing friction. It has been found that friction is one of the main causes of the high power requirements of such screen apparatus. It has also been found that it is difficult to maintain a uniform gap during operation of such apparatus, since the disks may not be mounted exactly at right angles or may become displaced slightly during operation, causing flutter with respect to each other during operation.

The disk screening apparatus heretofore used is also highly sensitive to sand, stones and scrap, and therefore subject to wear. To reduce such wear, it has been common to plate the disks with hard chromium, further increasing cost.

In my co-pending application, U.S. Ser. No. 07/629,924, I have disclosed a screening apparatus for wood chips or the like which has substantially higher industrial capacity than structures heretofore available, and which avoids the drawbacks associated with disk screening apparatus. The screen has a screening deck or bed which extends substantially horizontally, providing a large screening area. Chips are distributed across a receiving end of the screening deck, which is formed by a series of parallel bars have a unique top shape. Relative oscillatory motion is effected between sets of bars for effecting screening and moving the chips in a forward direction.

While the screen disclosed in my aforementioned co-pending application overcame many of the disadvantages of previously known screens, with high screening efficiency and greater capacity than obtainable with previously known screens, it was observed that some chips were conveyed substantial distances on the screen deck before proper presentation to a space between screen bars for the necessary gauging and screening of the chip.

It is therefore an object of the present invention to provide an improved bar screen which quickly tips and orients wood chips placed thereon for proper presentation to a screening space, to effect the necessary gauging and screening function.

It is another object of the present invention to provide a wood chip screen which has higher capacity for given screen sizes than do previously known screens of similar size.

SUMMARY OF THE INVENTION

In accordance with the present invention, the wood chip screen has a screening deck comprised of a plurality of sets of parallel bars, with bars of the various sets being interleaved with each other. At least one set of bars, and preferable each set of bars, is arranged to have adjacent bars at differing heights. Relative oscillatory motion is established between the sets of bars to tip the chips, thereby presenting a thickness dimension to the space between adjacent bars, and to transport the untipped and oversized chips along the bed formed by the interleaved parallel bars.

Further objects, advantages, and features of the present invention will become apparent from the following detailed description and the accompanying drawings.

DESCRIPTION OF THE DRAWINGS

FIGS. 4, 5, and 6 are schematic elevational illustrations showing different positions of the screening bars during screening operation;

DESCRIPTION OF THE PREFERRED EMBODIMENTS

Figure 1:
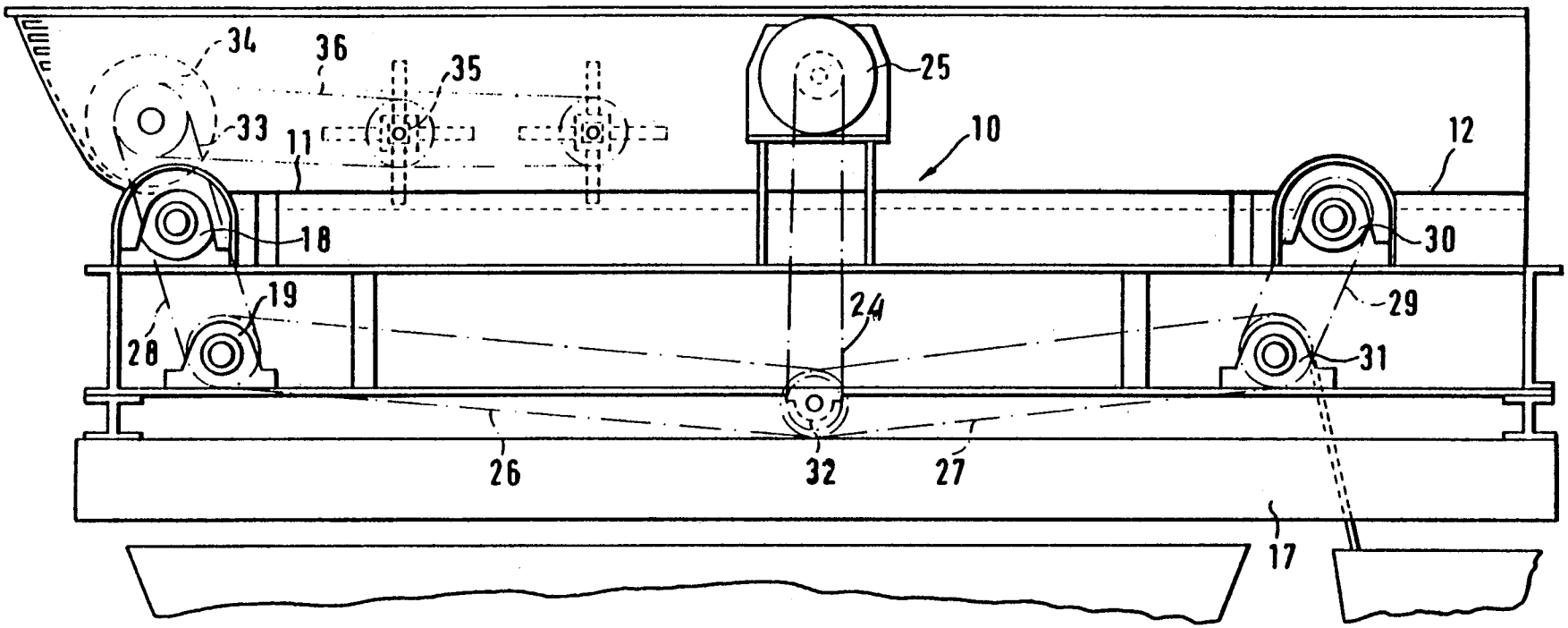
FIG. 1 is a side elevational view shown somewhat in diagrammatic form of a screening device constructed in accordance with the principles of the present invention.

As illustrated in FIG. 1, the mechanism includes a substantially horizontal, upwardly facing screening bed 10 having a receiving end 11 where the wood chips are received and a discharge end 12 where the reject material is discharged. The wood chips to be screened are received at the receiving end 11 and move along the bed from left to right as shown in FIG. 1, with the chips of acceptable width passing between screening bars, and the chips which are too large and other reject material which is too large continuing to move along the bed to be discharged at the discharge end 12 of the screening apparatus. While illustrated to be substantially horizontal, it will be recognized by those skilled in the art that, under some circumstances, advantages may be obtained by angling the deck, either upwardly or downwardly, from the receiving end to the discharge end.

As illustrated, the screen is for separating oversize from acceptable material. Properly sized and operated, for some applications, the screen can be used to remove undersized material as well. In such use, the material falling through the screen would be rejects, and that material discharged at discharge end 12 would be the acceptable material. Further use herein of the terms reject and accepts, or variations thereof, are for differentiation in description, and are not meant as limitations on the use of the present invention.

Figure 7:
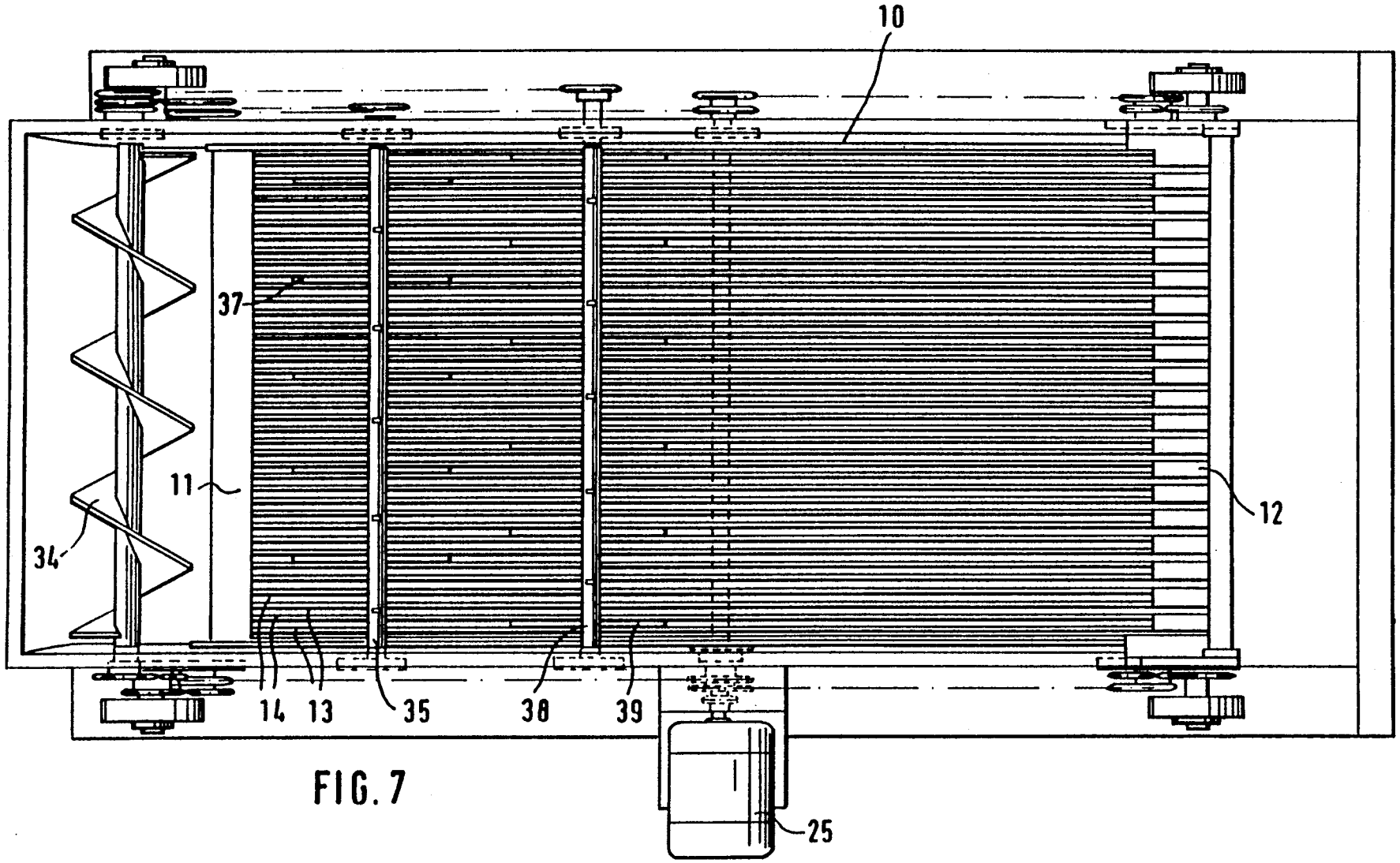
FIG. 7 is a top plan view showing the screening bed.

The screening bed is formed by a plurality of parallel bars mounted in at least two separate grids or sets 13 and 14 as illustrated in FIG. 7, with the bars having uniformly wide spaces therebetween. The grids or sets are interleaved so that adjacent bars are from alternate grids. The spaces are of predetermined width such that chips which are too large and which would be too thick to be satisfactorily penetrated by the liquor in a digester are not accepted but will stay on top of the screening bed to move off the discharge end 12.

To aid in the screening operation, and to aid in the movement of the chips from the receiving end 11 to the discharge end 12, the grids are oscillated by being moved both up and down and forward and back relative to a main screen frame 17 in a manner to be described in more detail hereinafter.

In accordance with the present invention, at least one grid or set of bars is provided with separate groups of bars having top surfaces disposed in at least two different planes. In a preferred arrangement, each grid of bars is provided with groups of bars having top surfaces in at least two different planes. That is, the top surfaces of the bars in any given grid do not form a single planar surface. The bars are so arranged that, in the preferred arrangement, within a given grid or set of bars, adjacent bars are at a different height, and in the assembled bed 10, adjacent bars are from different grids.

In FIG. 4, a first grid set of bars 60 having bars 60*a*, 60*b*, 60*c*, and 60*d* are shown interleaved with a second grid or set of bars 80 having bars 80*a*, 80*b*, 80*c*, and 80*d*. Two four bar grids are shown for illustration purposes, however, it should be understood that a commercial screen will normally include more than four bars in each grid. Every second bar of a grid is of similar height, having coplanar top surfaces. Thus, bar 60*a* is of similar height to bar 60*c* and bar 60*b* is of similar height to bar 60*d*. Bar 80*a* is of similar height to bar 80*c* and bar 80*b* is of similar height to bar 80*d*.

It may be desirable in some screening applications to provide grids having bars in more than two groups, with top surfaces defining more than two planes. For wood chip screening, two grids each having two groups of bars, has been found to work well.

While the groups of bars in each grid are vertically spaced at their top surfaces, all bars of a grid are fixed in position relative to each other and move in unison as the grid is oscillated.

For purposes of describing the operating cycle of the screen, the cycle will be presumed to start from a position wherein the grids are in position as illustrated in FIG. 4, wherein each grid of bars is at an opposite extreme of its range of movement. From this position, one grid moves upwardly and the other grid moves downwardly. FIG. 4 depicts the grids with the grid or set of bars 60 being at the upper most position in the operating cycle, and the grid or set of bars 80 being at the lower most position in the operating cycle.

From the position illustrated in FIG. 5, the bars 60 begin moving downwardly, and the bars 80 begin moving upwardly. At a point half-way through the range of movement of the grids, adjacent bars of the same relative position between grids will be at substantially equal heights, as illustrated in FIG. 5. Thus, the bars 60*a* and 80*a* are at equal height, as are the pairs 60*b* and 80*b*. The top surfaces of bars 60*c* and 80*c* will be coplanar with the tops of 60*a* and 80*a*, and the tops of bars 60*d* and 80*d* will be coplanar with the tops of 60*b* an 80*b*. Thus, the "a" pairs and "c" pairs are at equal height, as are the "b" and "d" pairs. The bars 80 continue moving upwardly, and the bars 60 continue moving downwardly, until a bar position substantially opposite that shown in FIG. 4 is reached, wherein the bars 80 are at the upper most position, and the bars 60 are at the lower most position. Again, as shown in FIG. 6, four different bar heights result.

Figure 6:
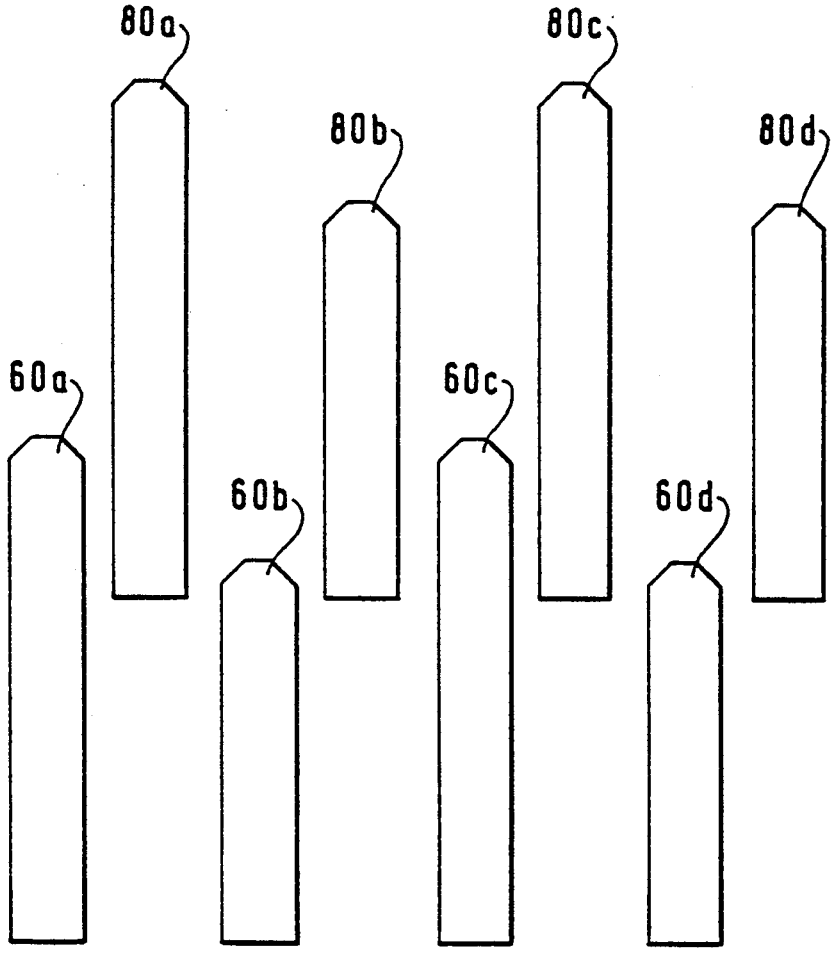

From the position depicted in FIG. 6, the grid or set of bars 80 begins moving downwardly, and the grid or set of bars 60 begins moving upwardly. At a point half-way through the range of movement, a bar positioning similar to that shown in FIG. 5 is achieved, and as the bars continue in their range of motion, the bar positioning shown in FIG. 4 is again achieved, and the process once again reverses.

Since the grids of bars are mounted on eccentric drives, the vertical movement is accompanied with horizontal movement. Thus, from the position illustrated in FIG. 5, as the bars 80 move upwardly they also move forwardly to the upper most position as shown in FIG. 6 and continue moving forwardly until mid-way through the cycle when the bars are again positioned as illustrated in FIG. 5. As the bars 80 move downwardly from the mid point, the bars also move rearwardly through the lower most position illustrated in FIG. 4, and continue moving rearwardly as the bar moves upwardly to the mid-way point illustrated in FIG. 5. The horizontal movement of bars 80 is the same as that for bars 60.

Thus, as a grid of bars moves upwardly from the position illustrated in FIG. 5 to its upper most position, and as the grid moves downwardly from the upper most position again to the position illustrated in FIG. 5, the grid also moves forwardly. As either grid moves downwardly from the position illustrated in FIG. 5 to the lower most position, and as the grid moves upwardly from the lower most position again to the position illustrated in FIG. 5, the grid moves rearwardly. Since the grids are 180° out of phase, one grid is moving forwardly as the other grid is moving rearwardly, and one grid is moving upwardly while the other is moving downwardly.

The combined movement of the bars up and down and forward and rearward conveys the oversize chips from the inlet end to the discharge end, and also aids in turning the chips so that the thickness dimension is presented to the space between bars, for proper screening.

Except for the exact position of the bars at the mid-point of movement, when only two bar heights result, the screen at all other times provides four different bar heights, for any group of four adjacent bars. Any chip not perfectly balanced on one bar is automatically tipped to angle downwardly between bars, unless the chip is large enough to span five bars and four inter-bar spaces. The result is that chips are very rapidly tilted such that a thickness dimension is presented to an inter-bar space, and the chip is properly positioned for gauging.

As illustrated in FIGS. 4, 5, and 6, the bars have an upper surface which is flat and parallel to the bed. At each side of the horizontal portion are tapered portions which provide planar surfaces sloping away from the top surface. These surfaces have been found to tend to prevent clogging of the gaps between the bars and to aid in material agitation and chip orientation.

For typical wood chip screening, acceptable bar dimensions have been found to be one-half inch in thickness and one and one-half to three inches in height from top to bottom. The top surfaces are about one-eighth inch wide, and the angular side surfaces are disposed at a forty-five degree angle from the top surface, and extend approximately one-quarter inch. The height difference between adjacent bars in a single grid or set should be about one-half inch.

While solid metal bars have been found to operate satisfactorily, it may be desirable in some instances to utilize bar construction other than of solid metal. For example, higher abrasion resistance may be needed in some situations, and in other applications it may be desirable to minimize weight. FIGS. 8 through 15 illustrate cross-sections of alternate bar constructions.

Figure 8:
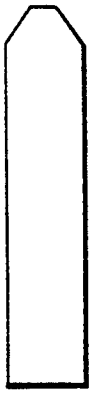
FIGS. 8, 9, 10, 11, 12, 13, 14 and 15 are cross-sectional illustrations of various alternate constructions for the bars of the present screen.

In FIG. 8, the bar is constructed of cast polyurethane, steel, or other solid material.

Figure 9:
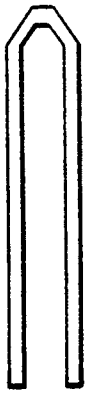

FIG. 9 illustrates a hollow bar which may be manufactured of formed metal.

Figure 10:
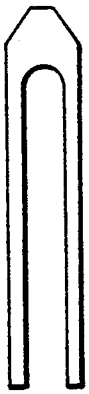

FIG. 10 illustrates a suitable extruded plastic or metal construction.

Figure 11:
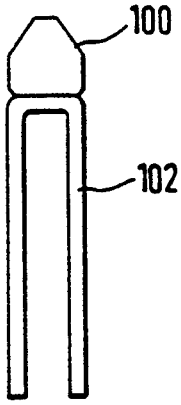

FIG. 11 illustrates a modular construction in which a bar tip 100 may be manufactured of a material harder or different from the material of a bar body 102. The tip is then suitably attached to the body. Depending on the types of material used, attachment may be by adhesion, welding or by fixtures such as rivets, screws or the like. The attachment selected may also take into consideration the need for tip replacement separate from replacement of the bar body.

Figure 12:
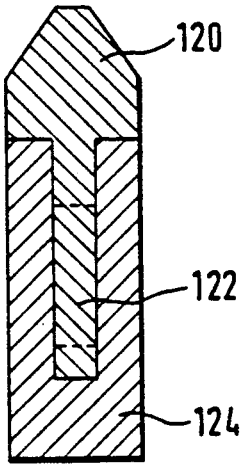
Figure 13:
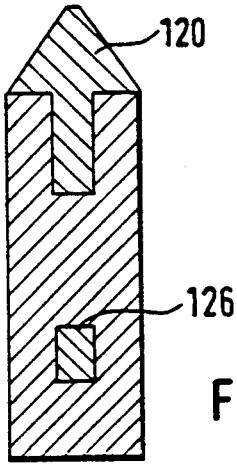

FIGS. 12 and 13 illustrate other constructions in which the tip is formed as the top and a center portion of the bar. Thus, the tip has a top portion 120 and lower portion 122, the lower portion being encased in a body portion 124 of material different from the tip portion. As illustrated in FIG. 12, the tip portion extends partially down the sides of the bar, whereas in FIG. 13, the tip portion is only the top of the bar. In one suitable construction of this type, extruded tool steel can be used for the tip portion, and the body may be made of polyurethane of suitable hardness for the application. The lower portion 122 may be provided with holes 126, which fill with polyurethane as the body portion 124 is cast about the lower portion 122, thereby affixing the two portions together.

Figure 14:
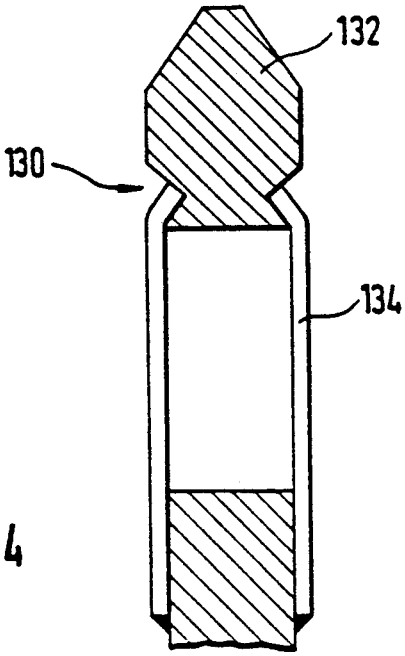
Figure 15:
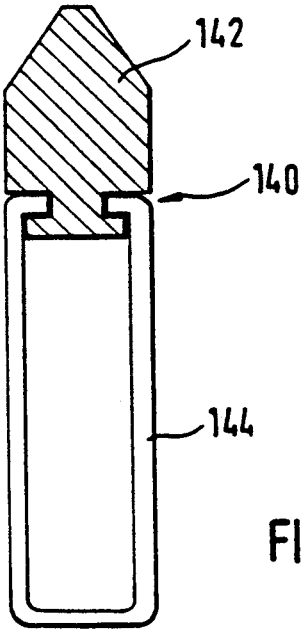

When it is anticipated that bar tips may need to be replaced frequently and quickly, the tips can be slidingly engaged with the bar body as illustrated in FIGS. 14 and 15. In FIG. 14, a dove-tail engagement 130 is provided between the a tip 132 and a body 134. In FIG. 15, a box-tail engagement 140 is provided between a tip 142 and a body 144. When sliding type engagements are used, short segments of the tip in high wear areas on the screen can be replaced without the need for replacing the entire length of tip on the bar.

Any of the modular constructions described above allow for the use of tip material most suitable for the intended application, and allow economic selection of materials for anticipated wear, impact and the like. The bodies of the bars can be made of lesser expensive materials.

In a simplified drive arrangement to oscillate the grids of bars each are mounted on movable frames which are carried on rotors having the movable frame eccentrically connected thereto. At the discharge end of the screening bed, the movable frames are connected to similar eccentric supports mounted on rotors.

Figure 2:
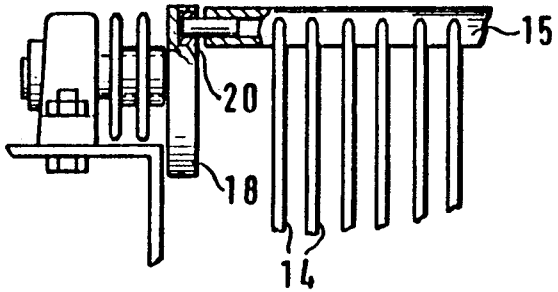
FIG. 2 is a fragmentary plan view of a simple driving mechanism for oscillating bars of the screening device.
Figure 3:
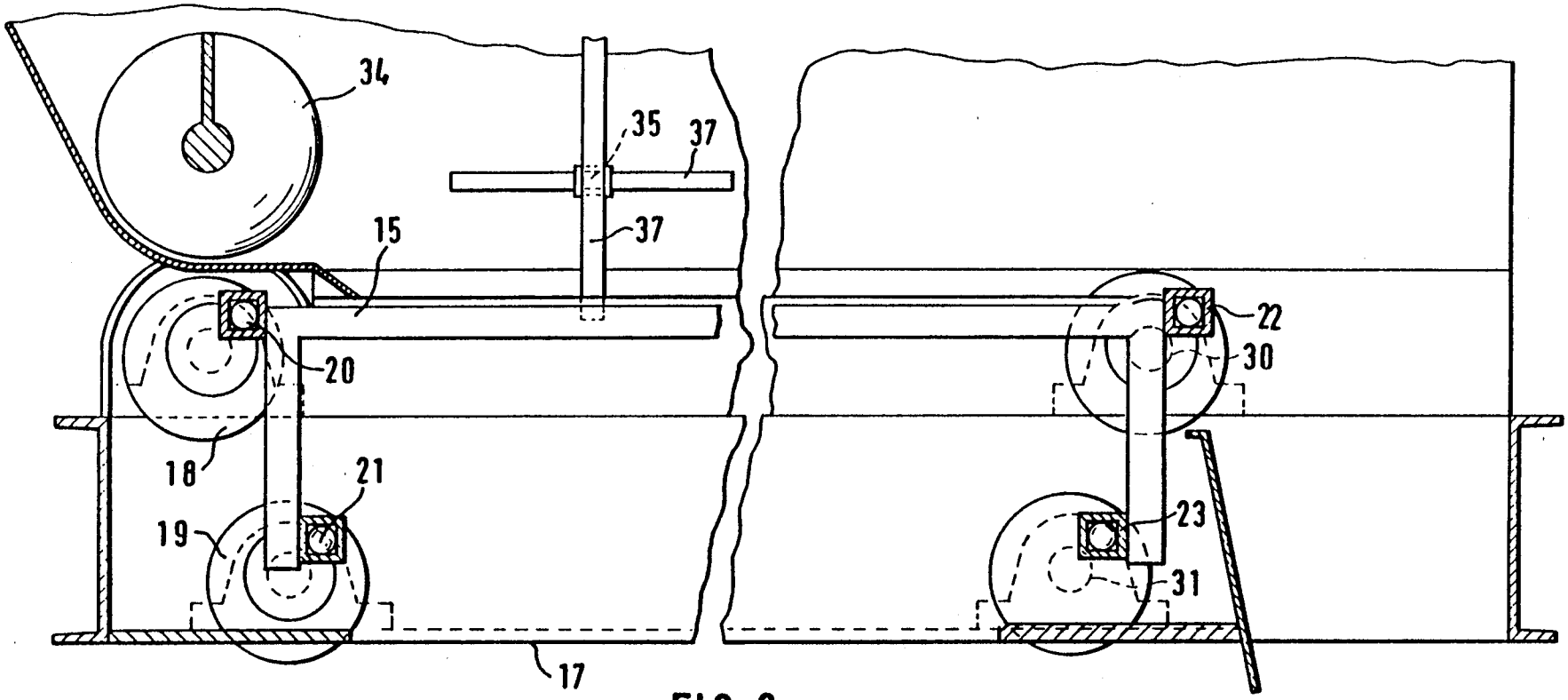
FIG. 3 is another side elevational view shown somewhat in schematic form, similar to FIG. 1 but illustrating the arrangement of the simple drive mechanism.

FIGS. 1, 2, and 3 best illustrate a simplified mounting of the grid of bar set 14, wherein a frame 15, to which the bars are attached, is carried on rotors 18 and 19 on the inlet end, eccentrically connected to the rotors at supports 20 and 21 respectively. At the discharge end of the screening bed, the frame 15 is connected to eccentric supports 22 and 23 on rotors 30 and 31. The frame of bar set 13 is similarly connected by eccentrically mounted supports **20*a* and 22*a* on rotors 18*a* and 30*a*** at both the inlet and outlet ends.

As the rotors at each end of the bar frames rotate, namely the rotors 18 and 19 at the receiving end of the screen and 30 and 31 at the discharge end of the screen, the bars will oscillate alternately up and down and alternately forward and back.

For driving the movable bars in oscillation, a main prime mover driver 25 is provided. This drives a chain 24 driving a sprocket 32. The sprocket contains additional sprockets driving chains or belts 26 and 27 which are connected to drive the rotors 19 and 31. These rotors carry sprockets which, through chains or belts 28 and 29, drive the upper rotors 18 and 30. A similar drive assembly is provided on the opposite side of the screen.

Figure 16:
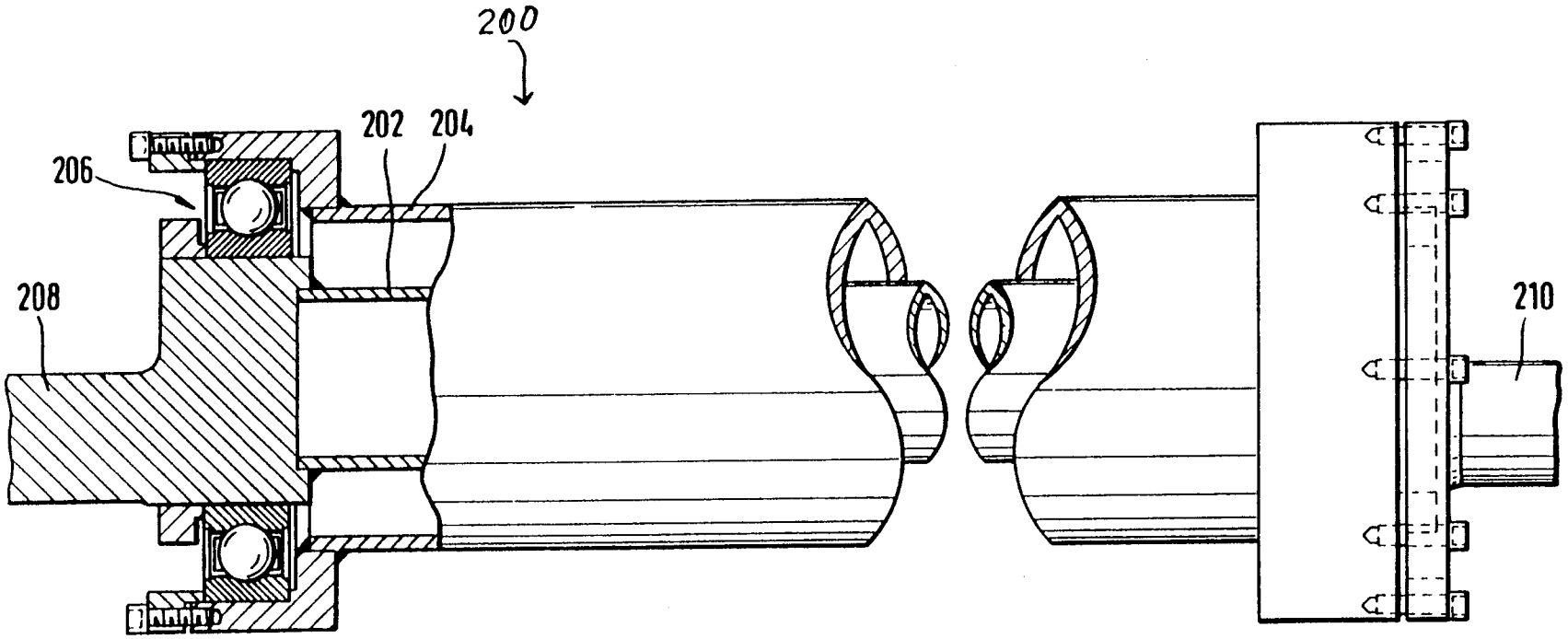
FIG. 16 is a plan view, in partial cross-section, of a preferred drive arrangement for the screen.

As described previously herein, drives for the shafts to oscillate the grids are provided on both sides, and require independent cranks connected by timing chains or belts on both sides of the screen. A through crank design may also be utilized, and may be preferred to the aforementioned drive in instances wherein timing is critical and horsepower reduction is desired. A through crank assembly 200 of suitable design is illustrated in FIG. 16. The through crank assembly includes inner and outer shafts 202 and 204, respectively. A bearing 206 is provided between the inner and outer shafts at each end of the through crank assembly. The inner shaft is driven at a stub shaft 208 which is eccentric with respect to the outer shaft 204. Rotation of the stub shaft 208 causes the outer shaft 204 to move in the desired combined horizontal and vertical pattern relative to the axis of the stub shaft 208. The stub shaft 208 and a coaxial stub shaft 210 at the opposite end of the assembly are fixed with respect to the main screen frame 17, and the outer shaft is connected to a set of bars or grid, to impart the desired motion to the grid.

Figure 17:
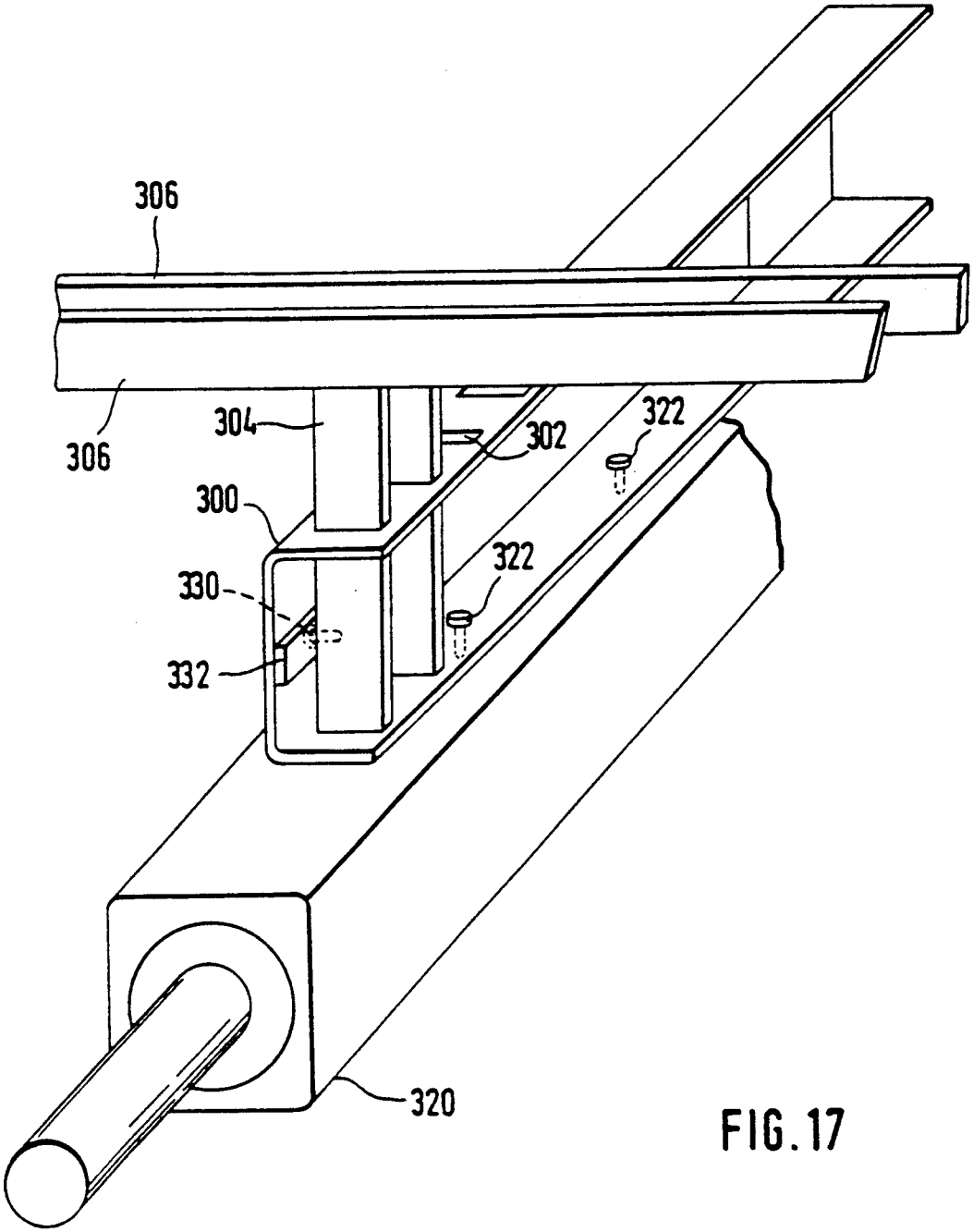
FIG. 17 is a perspective view of a preferred arrangement for attaching the bars of the screen to the drive mechanism.

To ease and facilitate bar replacement, and to control bar spacing, a bar positioning and retention arrangement can be provided. Such an arrangement is illustrated in FIG. 17. A bar positioning and retention member 300 includes a plurality of precisely located slots 302, to secure and retain leg portions 304 from individual bars 306 in a bar set. The member 300 may be channel iron or other similar material, and is preferably connected to a drive shaft assembly 320 by a plurality of bolts 322. It should be recognized that the member 300 can be connected to the outer shaft 204 of the aforementioned through crank assembly 200. The retention member 300 may alternatively be connected to the drive shaft assembly 320 by welding or other suitable permanent means. However, if removable means such as bolts 322 are used, the screen can be adapted quickly to provide different screen spacings by changing the member 300 to an alternate member which provides the desired spacing between the slots 302. Each of the legs 304 from the bars 306 are retained in its respective slot 302 by a bolt 330 extending through a backing member 332. With this construction, if one or several bars are damaged, the damaged bars can be replaced quickly and easily by removing the retaining bolt 332 holding the damaged bar and inserting a replacement bar and leg. As mentioned previously, the screen can be quickly modified for different screen spacing by unfastening the retaining member 300 from the shaft assembly 320, and replacing it with a different member having the desired spacing between slots 302.

For distributing the wood chips laterally relatively uniformly across the receiving end of the screening bed, distributing auger 34 is mounted for rotation and is driven by a chain 33. Such augers are conventional devices for distributing material along their length and will not be described in greater detail herein.

To increase retention time on the bed, and to orient the chips in a longitudinal direction, fingers 37 are provided to move through the chips on the screen bed 10. For this purpose, the fingers are carried on a rotor 35 which is driven by a drive chain 36 in rotation in a clockwise direction as shown in FIG. 1. The fingers 37 pass through the chips against the direction of movement of the chips along the grids. This increases the retention time of the chips on the screen and tends to orient the material in the longitudinal direction, improving the screening operation and improving the efficiency and uniformity by properly aligning the chips for screening, so that minimal bridging of chips occurs.

As shown in FIG. 6, two shafts with fingers are used. In some instances, one may be adequate and in others more than two may be desirable. Shafts with evening fingers positioned downstream from the inlet may be provided with fingers spaced more closely than shafts closer to the inlet end. The more closely spaced fingers will properly orient more chips, and, since the volume of chips on the screen downstream from the inlet is reduced from the volume at the inlet end, the closely spaced fingers will not overly retard oversize chip advancement.

In operation, wood chips are distributed laterally along the receiving end 11 of the screening deck 10. The wood chips move along the screening bed longitudinally toward the discharge end 12, and those which are sufficiently thin will pass through the spaces between the bars. The bars supported on the movable grids oscillate up and down in the manner shown in FIGS. 4, 5, and 6. To delay the movement of the chips and to help orient the chips in a longitudinal direction, fingers 37 carried on rotor 35 are moved against the direction of chip movement. Acceptable chips of the maximum tolerable thickness and narrower will pass through the spaces between the bars, and other unacceptable chips will continue on down the screening deck toward the discharge end 12.

The stroke of each bar should be only slightly less than the maximum overlap between adjacent bars at the mid-point of their range of movement, as illustrated by the distance P in FIG. 5, or slightly less than twice the shortest distance of overlap between adjacent bars at the mid-point of their range of movement, as illustrated by the distance Q in FIG. 5, which ever distance is least. Thus, if bars **60*a* and 80*a* overlap a distance P of two inches, and bars 80*a* and 60*b* overlap a distance Q of one inch, the maximum vertical range of travel of the bars should be only slightly less than two inches. Some vertical overlap between adjacent bars should be maintained at all times, so that proper screen opening size is maintained between adjacent bars, and so that chip wedging does not occur. However, the overlap region should be minimal when the grids are at the extreme positions shown in FIGS. 4 and 6**. This opens up the screen below each screen opening, again minimizing chip wedging and allowing "caught" chips to pass through without clogging the screen.

For typical wood chip screening, bar displacements of 2 inches to 3 inches are preferred, with the rotary drives to which the bars are eccentrically connected being driven at 200 to 250 r.p.m. Too slow operation and too shallow of displacements result in chip matting due to insufficient agitation and insufficient chip tipping. Excessive speeds of the drive cause the chips, and particularly smaller acceptable chips, to become suspended above the screen, limiting engagement time for proper sizing.

Thus, it will be seen I have provided an improved chip screening device which meets the objectives and advantages above set forth and provides an improved, simplified screening mechanism.

I claim:

1. A screening apparatus for separating a particular material by material thickness comprising in combination:

a screen deck defining a screening area with screening openings and extending from a receiving end to a discharge end, with delivery means for distributing material onto the screening deck at the receiving end to move toward the discharge end so that large material moves longitudinally the length of the deck from the receiving end to the discharge end, and smaller thickness material passes through the screening deck;

said deck having a plurality of individual screening bars extending from the receiving end to the discharge end and arranged in spaced relationship to define openings therebetween for passing therebetween the material of smaller thickness;

said bars extending parallel to each other, with bars being fixedly mounted with respect to each other into at least two independent grids, and with the bars of at least one of said grids including a first group of bars having top surfaces thereof which are coplanar and a second group of bars having top surfaces noncoplanar with said top surfaces of said first group of bars.

said independent grids being connected to drive means for moving the grids in an orbital motion throughout the bar length, for causing material spanning adjacent bars on the deck to be tipped to present a thickness, dimension for size discrimination.

2. A screening apparatus for separating a particulate material constructed in accordance with claim 1:

wherein said screening bars are disposed in two grids, and each of said grids are mounted to eccentric drive mechanisms such that one of said grids is driven upwardly while the other of said grids is driven downwardly.

3. A screening apparatus for separating a particulate material constructed in accordance with claim 2:

wherein each of said grids includes at least two groups of bars having top surfaces disposed in at least two separate planes.

4. A screening apparatus for separating a particulate material constructed in accordance with claim 1:

wherein alternate screening bars of the screening apparatus are collectively joined into grids, thereby defining two grids, and said grids are mounted for vertical and horizontal movement.

5. A screening apparatus for separating a particulate material constructed in accordance with claim 1:

wherein each of said grids includes first and second groups of bars, each of said groups includes bars having coplanar top surfaces, and the top surfaces of the groups of bars in a grid define separate planes.

6. A screening apparatus for separating a particulate material constructed in accordance with claim 5:

wherein in each of said grids the bars of a grid are arranged so that alternate bars of a grid are collectively joined into groups.

7. A screening apparatus for separating a particulate material constructed in accordance with claim 6:

wherein alternate screening bars of said deck are collectively joined into separate grids.

* * * * *